US009272804B2

(12) United States Patent
Pippin

(10) Patent No.: US 9,272,804 B2
(45) Date of Patent: Mar. 1, 2016

(54) BUNDLE UNWRAPPING MACHINE

(75) Inventor: James M. Pippin, Keller, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 1087 days.

(21) Appl. No.: 12/466,629

(22) Filed: May 15, 2009

(65) Prior Publication Data

US 2009/0282787 A1 Nov. 19, 2009

Related U.S. Application Data

(60) Provisional application No. 61/053,904, filed on May 16, 2008.

(51) Int. Cl.

| | |
|---|---|
| ***B65B 43/00*** | (2006.01) |
| ***B65B 43/26*** | (2006.01) |
| ***B67B 7/00*** | (2006.01) |
| ***B65B 69/00*** | (2006.01) |

(52) U.S. Cl.

CPC ..... *B65B 69/0033* (2013.01)

(58) Field of Classification Search

CPC B65B 69/0033; B65B 69/0025; B65B 69/00; B26D 1/04

USPC ..... 53/381.1, 381.2, 381.3, 492

See application file for complete search history.

(56) References Cited

U.S. PATENT DOCUMENTS

| | | | | | |
|---|---|---|---|---|---|
| 3,889,442 | A | * | 6/1975 | Grahn et al. | 53/492 |
| 4,995,771 | A | * | 2/1991 | Sedgeley et al. | 414/412 |
| 5,067,303 | A | * | 11/1991 | Brookman et al. | 53/381.2 |
| 5,318,399 | A | * | 6/1994 | Marom | 414/412 |
| 5,442,895 | A | * | 8/1995 | Linson | 53/381.2 |
| 5,615,993 | A | * | 4/1997 | Tanaka | 414/810 |
| 5,649,801 | A | * | 7/1997 | White | 414/412 |
| 5,752,359 | A | * | 5/1998 | Oord | 53/381.2 |
| 7,343,722 | B1 | * | 3/2008 | Rutten | 53/381.2 |
| 7,549,274 | B2 | * | 6/2009 | Fraser | 53/492 |
| 7,963,086 | B2 | * | 6/2011 | Porter et al. | 53/381.2 |

(Continued)

FOREIGN PATENT DOCUMENTS

| | | | |
|---|---|---|---|
| DE | 3943745 | C2 | 10/1997 |
| EP | 0698424 | A1 | 2/1996 |

(Continued)

OTHER PUBLICATIONS

European Search Report mailed Oct. 9, 2013 corresponding to EP Application No. 09160481.9 filed May 18, 2009 (7 pages).

*Primary Examiner* — Stephen F Gerrity
*Assistant Examiner* — Eyamindae Jallow

(57) ABSTRACT

A method and apparatus are provided for automatic bundle transport, positioning, wrapper entry, wrapper opening, wrapper loosening, wrapper removal and wrapper dunnage takeaway. The wrapper is made from pliable material, thin film or similar material and which can comprise a variety of package types and sizes of mail, media or other items. Additionally the method and apparatus of the invention performs the tasks of wrapper removal and discharge without damaging the item contents within. A bundle unwrapping machine according to the invention includes a conveyor by which bundles are presented to the unwrapping machine for opening. An opening mechanism includes a pair of openers positioned to engage a bundle on opposite sites. The bundle is transported into an opening zone in which it is supported for engagement with the openers.

14 Claims, 9 Drawing Sheets

(56) References Cited

U.S. PATENT DOCUMENTS

| | | | | |
|---|---|---|---|---|
| 8,117,733 | B2 * | 2/2012 | Reggiani et al. | 29/564.3 |
| 2003/0177740 | A1 * | 9/2003 | Rutten | 53/492 |
| 2004/0055438 | A1 * | 3/2004 | Ours et al. | 83/861 |
| 2004/0194428 | A1 * | 10/2004 | Close et al. | 53/381.2 |
| 2007/0169438 | A1 * | 7/2007 | Brown | 53/492 |
| 2008/0256907 | A1 * | 10/2008 | Fraser | 53/492 |
| 2009/0113853 | A1 * | 5/2009 | Porter et al. | 53/492 |
| 2009/0301031 | A1 * | 12/2009 | Jacobs et al. | 53/381.2 |
| 2010/0218458 | A1 * | 9/2010 | Benini et al. | 53/381.2 |

FOREIGN PATENT DOCUMENTS

| | | | |
|---|---|---|---|
| JP | H07149327 | A | 6/1995 |
| JP | 2002193558 | A | 7/2002 |
| WO | 9411254 | A1 | 5/1994 |
| WO | 03091115 | A1 | 11/2003 |

* cited by examiner

BUNDLE UNWRAPPING MACHINE

This application claims priority of U.S. provisional application No. 61/053,904 filed May 16, 2008.

FIELD OF THE INVENTION

The invention relates to systems for the automated opening of packages such as shrink wrapped bundles of flat mail pieces.

BACKGROUND OF THE INVENTION

The time consuming task of opening wrapped packages of mail, media or other similar items without damaging the contents within is currently performed manually. The specific tasks of piercing an entry point into the wrapper, enlarging the entry point, loosening the wrapper surrounding the contents and then removing the wrapper from the contents and placing the removed wrapper in a waste receptacle or dunnage takeaway is today laboriously performed manually. Improvements to aid this task have been proposed as in Redford et al. United States Patent Application 20050120675, Jun. 9, 2005. According to this publication a method of preparing flat articles for sorting includes the steps of: (1) receiving a bundle of flat items to be sorted, the bundle being wrapped with a flexible film such that the film forms an enclosed package of flat items, (2) placing the bundles on a substantially horizontal, substantially frictionless work surface, moving the bundle adjacent at least one film opener, the film opener being automatically activated when the bundle is moved adjacent the film opener, (3) removing the cut film from the flat items, and (4) stacking the unbundled flat items in a cartridge. This is still fundamentally a manual process.

While automated systems for opening boxes and the like are known, plastic wrapped bundles of flat items like mail are particularly difficult to unwrap by machine. The plastic conforms closely to the contents and an operation of cutting it away with blades or the like would inevitably damage the contents. The present invention attempts to resolve this problem and enable automated unwrapping of plastic wrapped bundles. See for example the system of Porter et al. U.S. Patent Pub. 2009/0113853. In this system content damage is likely during opening, and unwrapping is manual.

SUMMARY OF THE INVENTION

The present invention provides a method and apparatus for automatic bundle transport, positioning, wrapper entry, wrapper opening, wrapper loosening, wrapper removal, and wrapper dunnage takeaway. The wrapper is made from pliable material, thin film or similar material and which can comprise a variety of package types and sizes of mail, media or other items. Additionally the method and apparatus of the invention performs the tasks of wrapper removal and discharge without damaging the item contents within. A bundle unwrapping machine according to the invention includes a conveyor by which bundles are presented to the unwrapping machine for opening. An opening mechanism includes a pair of openers positioned to engage a bundle on opposite sites. The bundle is transported into an opening zone in which it is supported for engagement with the openers.

According to one aspect of the invention, a machine for removing plastic wrapping from a bundle of flat articles wrapped in plastic includes a conveyor for transporting a wrapped bundle through the machine, a first blade assembly including a pointed blade mounted on a holder provided with a mechanical actuator that slides the blade point first along the surface of the outer face of the bundle, such that the point of the blade pierces the plastic causing the blade to move beneath the plastic wrapping while sliding along the outer surface of one of the flat articles without damaging it, and the blade stretches and tears the plastic as it continues to move beneath the plastic wrapping; and an automated removal and disposal system which separates the torn plastic from the flat articles. In a preferred form a vacuum system includes a vacuum head that applies suction to an outer face of the bundle, drawing the plastic film towards the vacuum head and creating a bulge in the plastic wrap which the blade is positioned to pierce.

An automated method for removing plastic wrapping from a bundle of flat articles wrapped in plastic or similar sheet material comprises transporting a wrapped bundle on a conveyor into an automated unwrapping machine. The machine slides a first blade assembly including a pointed blade mounted on a holder point first along the surface of the outer face of the bundle, such that the point of the blade pierces the plastic causing the blade to move beneath the plastic wrapping while sliding along the outer surface of one of the flat articles without damaging it.

continuing movement of the blade continues after piercing of the wrapping to stretch and tear the plastic as it continues to move, and then the torn plastic is automatically separated from the flat articles.

A wrapper or wrapping according to the invention can be shrink wrap or a bag that encloses the articles completely, but could also be a less than complete covering such as a band. Plastic is the most common material for the wrapper, but paper or other similar material could be used. These and other aspects of the invention are further discussed in the detailed description that follows.

BRIEF DESCRIPTION OF THE DRAWINGS

In the accompanying drawing, wherein like numerals denote like elements.

For like elements referred to by both a number and letter (rod 52A, rod 52B etc.), references to plural parts without a letter mean some or all are referred to as indicated by the context.

DETAILED DESCRIPTION

As used herein, an operation that occurs "automatically" is performed by a machine, not a human being. In the description that follows a bundle unwrapping machine 10 according to the invention includes a number of moving parts, many of which are arranged in pairs for simultaneous coordinated movement. For the opener blades, vacuum heads, unwrapping fingers, grippers and the various movable stops, basic actuation components include linear actuators in the form of electric solenoids with extendable rods that are connected to the part to be moved by extension or retraction of the solenoid. Where needed to account for variations in position, the moving parts can be provided with proximity or contact sensors connected to the control system. In some cases a spring may be sufficient to bias the part in the desired position. Examples of these actuation systems are discussed further below. Movement is gradual, that is, at a low enough speed to avoid damage to the bundle. The control system could be a computer or PLC programmed to carry out the steps as described hereafter. The system may or may not need to be reprogrammed for bundles of different types and sizes, or can be provided with sensors that tell the control system process parameters to use.

Figure 1:
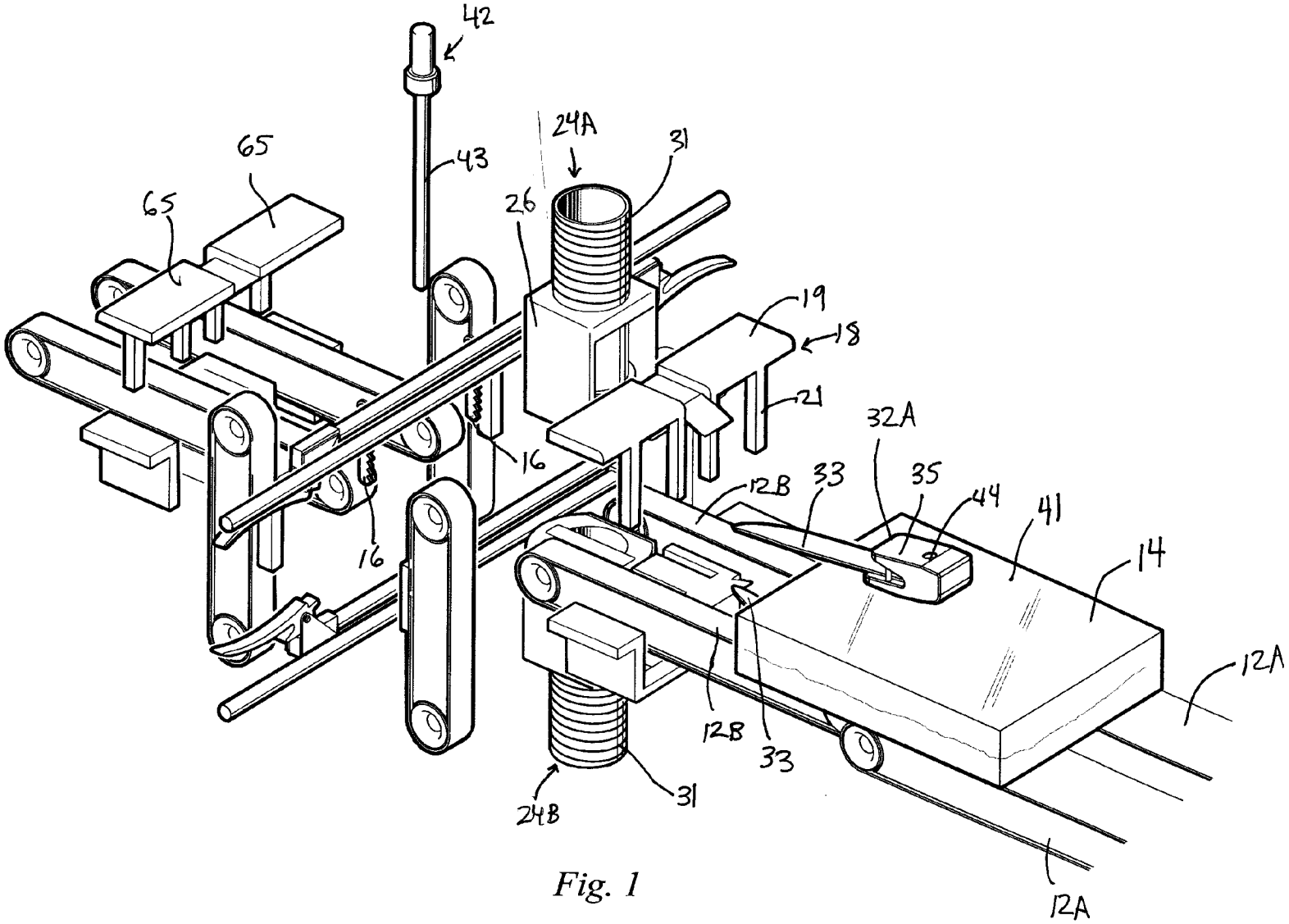
FIG. 1 is a simplified perspective view of an unwrapping machine according to the invention in an initial position.

The apparatus and method of the invention are described with reference to an example showing the sequence of operations undertaken. Referring to FIG. 1, a bundle unwrapping machine 10 according to the invention includes a pair of horizontal, parallel spaced belt conveyors 12A for transporting a plastic wrapped bundle 14. A second pair of conveyors 12B accept bundle 14 from conveyors 12A and take it further into machine 10 as described below. Bundle 14 is typically flat on opposite top and bottom faces an most often rectangular in shape. It comprises a stack of magazines, catalogs or the like wrapped with a thin plastic film on all sides. In the process of the invention as practiced in a commercial environment, bundles 14 are removed from a pallet and placed on a roller conveyor for manual inspection. Exception bundles such as ones damaged in transit are removed for manual opening. Bundles 14 suitable for automated opening are placed one at a time on conveyors 12A centered in the widthwise direction so that the underside of the bundle 14 can be accessed from below through the gaps between conveyors 12A, and between conveyors 12B.

Figure 1B:
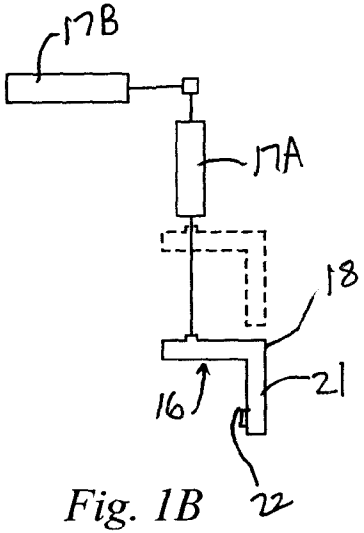
FIG. 1B is a schematic diagram of an actuation system for the rear end grippers shown in FIG. 1.
Figure 1A:
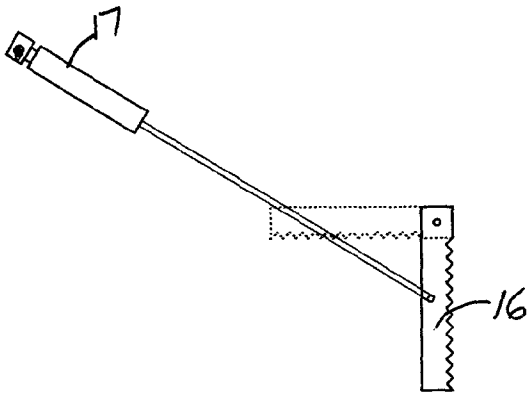
FIG. 1A is a schematic diagram of an actuation system for the front end gates shown in FIG. 1.

As or before bundle 14 moves forward on conveyors 12A, one or more retractable stop gates 16 are moved into position to stop bundle 14 at a desired forward position for opening. Each gate 16 in this example pivots into and out of position by means of a pivotably mounted linear actuator 17 as shown in FIG. 1A. However, gates 16 could also be configured to rise and drop vertically.

One or more grippers 18 are provided to grip the trailing end of bundle 14 once it engages gates 16. Grippers 18 are L-shaped brackets with an upper horizontal beam 19 and one or more downwardly depending arms or flanges 21. Each gripper 18 is raised or lowered by means of a first linear actuator 17A, and the assembly of gripper 18 and actuator 17A can be moved horizontally by a second linear actuator 17B (FIG. 1B). Grippers 18 start in the up position so that bundle 14 can pass beneath them, are lowered using actuator 17A, then drawn forward by actuator 17B so that fingers 21 engage the rear end of bundle 14. Complete engagement can be detected by means of a pressure sensor 22 that tells the control system that the bundle 14 has been firmly held between gates 16 in front and grippers 18 behind.

Once bundle 14 is in position and held as described, the operation of opening and removing the outer plastic wrap begins. A vacuum assembly 24A is suspended above the mid-portion of machine 10 and is preferably centered on bundle 14. Assembly 24A may be raised and lowered by any suitable means, such as a linear actuator or an electric pulley operated by the control system. An inverted U-shaped rectangular frame 26 retains a hose 27 which extends through an opening in its top wall. Frame 26 provides a pair of control pads 28 on opposite sides of its bottom edge that move down ahead of a central vacuum head 29 at the end of hose 27. Pads 28 move into engagement with the upper surface of the bundle 14 before suction is applied, and optionally may be biased by a coil spring 31 that exerts force against the upper surface of frame 26.

This engagement acts to control the differential deflection range of the plastic film relative to the surface of the underlying article once vacuum head 29 exerts suction against the plastic beneath it on the upper side of bundle 14. Differential deflection refers to the difference between the distance the plastic deflects under suction as compared to the distance the underlying item deflects. Unless a sufficient differential is maintained, the first page of the top item of the bundle contents will be pulled up by the suction along with the plastic wrap. Heating as described below helps avoid this problem. With the plastic film held down by pads 28, suction from vacuum head 29A causes the plastic wrap to deflect upwardly, creating an upwardly extending bulge in the plastic covering that is positioned for piercing. For this purpose vacuum head 29A may be lowered into contract with the top of bundle 14 and then raised a short distance once vacuum has been applied. A lower vacuum head 29B of a second vacuum assembly 24B engages the underside of bundle 14 in the same manner and is actuated at the same time and controlled in the same manner but in reverse orientation.

In a preferred embodiment, heat is applied to the area of the plastic wrap that the vacuum head is about to engage. A stream of forced air is suitable, which air is heated to a temperature sufficient to soften the plastic wrap without damage to the underlying contents. This may be done manually or automatically. A temperature of up to 150° F. is usually suitable, causing the plastic wrap to deflect more than the paper of an underlying page or magazine cover. The vacuum aids this process because it draws the heated air directly to the site where the bulge is to be created.

Figure 1C:
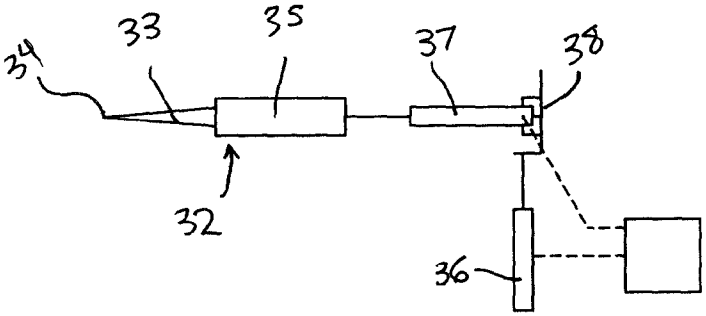
FIG. 1C is a schematic diagram of an actuation system for the upper and lower blade assemblies shown in FIG. 1.

A pair of upper and lower piercing blade assemblies 32A and 32B are provided above and below the space reserved for bundle 14. As shown in FIG. 1C, assemblies 32 are each configured for horizontal and vertical movement and may be essentially identical although reverse in orientation relative to each other. Each assembly 32 includes a plastic blade 33 with a pointed tip 34 but lacking a sharp side cutting edge. Blades 33 are made of a smooth surfaced molded plastic, although other materials could be used, including metal. Plastic however is preferred because it is less likely to catch on and damage the contents of the bundle under the plastic wrap.

Blades 33 are mounted to extend forwardly, flat, slightly rounded side down, from a tang or mounting block 35 that also can be made of plastic. As with other parts that need to move both horizontally and vertically at different times, the blade assemblies 32A,B each include a vertical linear actuator 36 and a horizontal linear actuator 37. The plunger of actuator 37 is connected to block 35 so that operation of actuator 37 extends or retracts blade 33. A frame 38 connects actuator 37 to the operative end (plunger) of actuator 36. By this means extension or retraction of actuator 36 raises or lowers the assembly of blade 33, block 35, actuator 37 and frame 38. If needed proximity or contact sensors can be provided if needed to prevent over extension of the actuators 36 and 37, or the cycle timing may be used to control these actuators. Once vacuum head 29A moves into proximity to the upper surface of bundle 14, the suction is sufficient to stretch and hold the underlying plastic wrap. A similar event takes place in the underside of bundle 14 using the bottom vacuum head 29B. Some bundle types have voids therein on the top and bottom that the blades 33 of the invention can readily penetrate, and for bundles of this kind, vacuum assemblies 24A, 24B need not be used.

Figure 2:
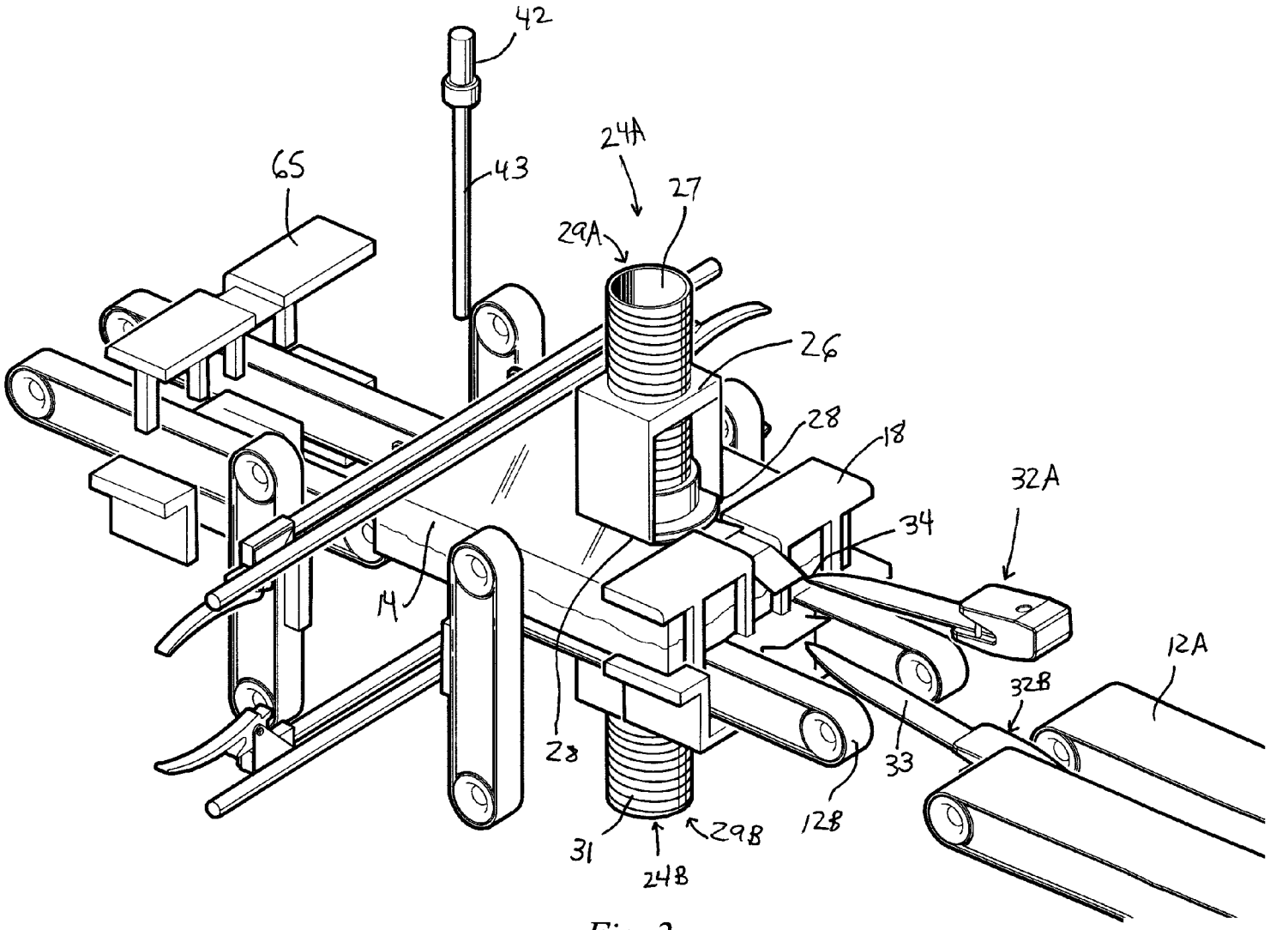
FIG. 2 is a simplified perspective view of the unwrapping machine of FIG. 1 in a second position.

FIG. 2 shows the bundle 14 in position for piercing the plastic wrap before the blade assemblies start to advance. Both sets of actuators 36 and 37 are then actuated so that blades 33A and 33B move to the correct vertical position relative to the bulges created in the plastic wrap, and the blades 33A, 33B advance simultaneously towards the upper and lower bulges 40. Points 34 of the blades readily pierce the plastic wrap and slide along the surface of the topmost flat item in bundle 14, such as a magazine. The speed of movement of blades 33A,B is preferably slow enough to minimize the likelihood of damage to the bundle contents, for example from 0.1 m/sec to 10 m/sec, preferably 0.5 m/sec to 2 m/sec. Once the plastic film has been pierced by blades 33A,B then suction from vacuum assemblies 24A, 24B is discontinued and assemblies 24A, 24B are moved vertically back to their starting positions. Frames 26 mounted on the vacuum heads 29A, 29B move far enough to avoid mechanical interference with parts moving below and above.

FIG. 2 shows the bundle 14 in position for piercing the plastic wrap before the blade assemblies start to advance. This operation may be timed and pre-programmed based on the known length of bundles 14, or based on the horizontal spacing, between stop gate 16 and grippers 18.

Figure 3:
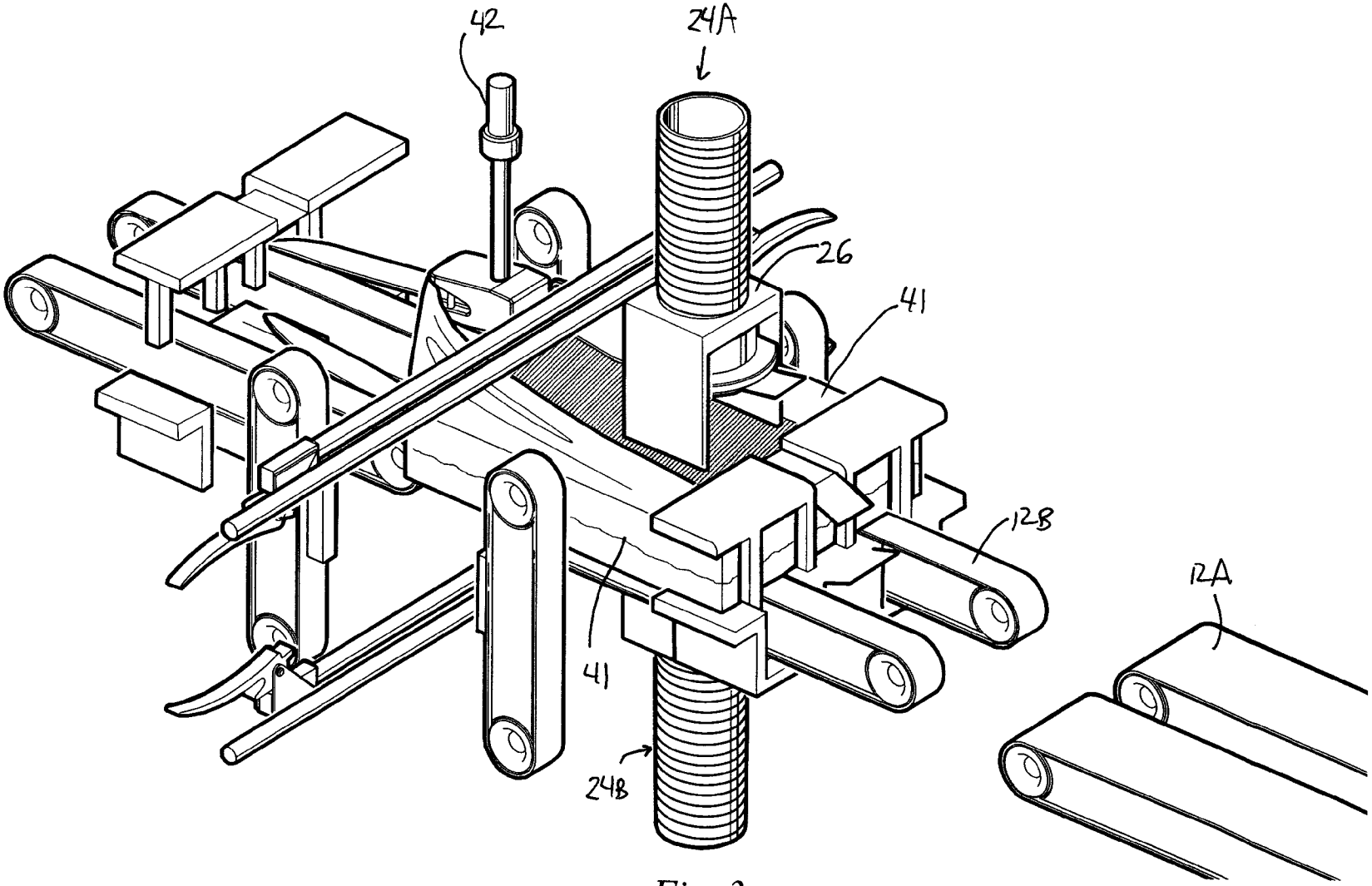
FIG. 3 is a simplified perspective view of the unwrapping machine of FIG. 1 in a third position.

As shown in FIGS. 2-3, the sides of blades 33A, 33B taper towards the tip 34 to provide plow-like forces that stretch-tear the plastic wrap along the path of movement of each blade 33A,B. This is not the same as cutting the film with a sharp edge of the blade and has the advantage of creating a wider opening in the top layer of plastic film and stretching the wrapping which relieves hoop stresses, making contents removal easier in later steps. FIG. 3 shows blades 33A, 33B at the front edge of bundle 14, which has now been partially torn open on top and bottom. The plastic wrap 41 has gathered at the front of block 35 and is stretched away from the contents of the bundle 14. Block 35 has moved into position below a vertical opener 42. Opener 42 includes a pin 43 that is lowered by a linear actuator thorough a hole 44 in block 35. With pin 43 extended through the stretched film at a position in front of the bundle contents, block 35 of blade 33A is then driven further forward by its horizontal actuator 37 carrying pin 43 with it. For this purpose it may be useful to use a hold and release style of robotic vertical actuator for openers 42 that grips, moves and then releases the head of pin 43.

Figure 4:
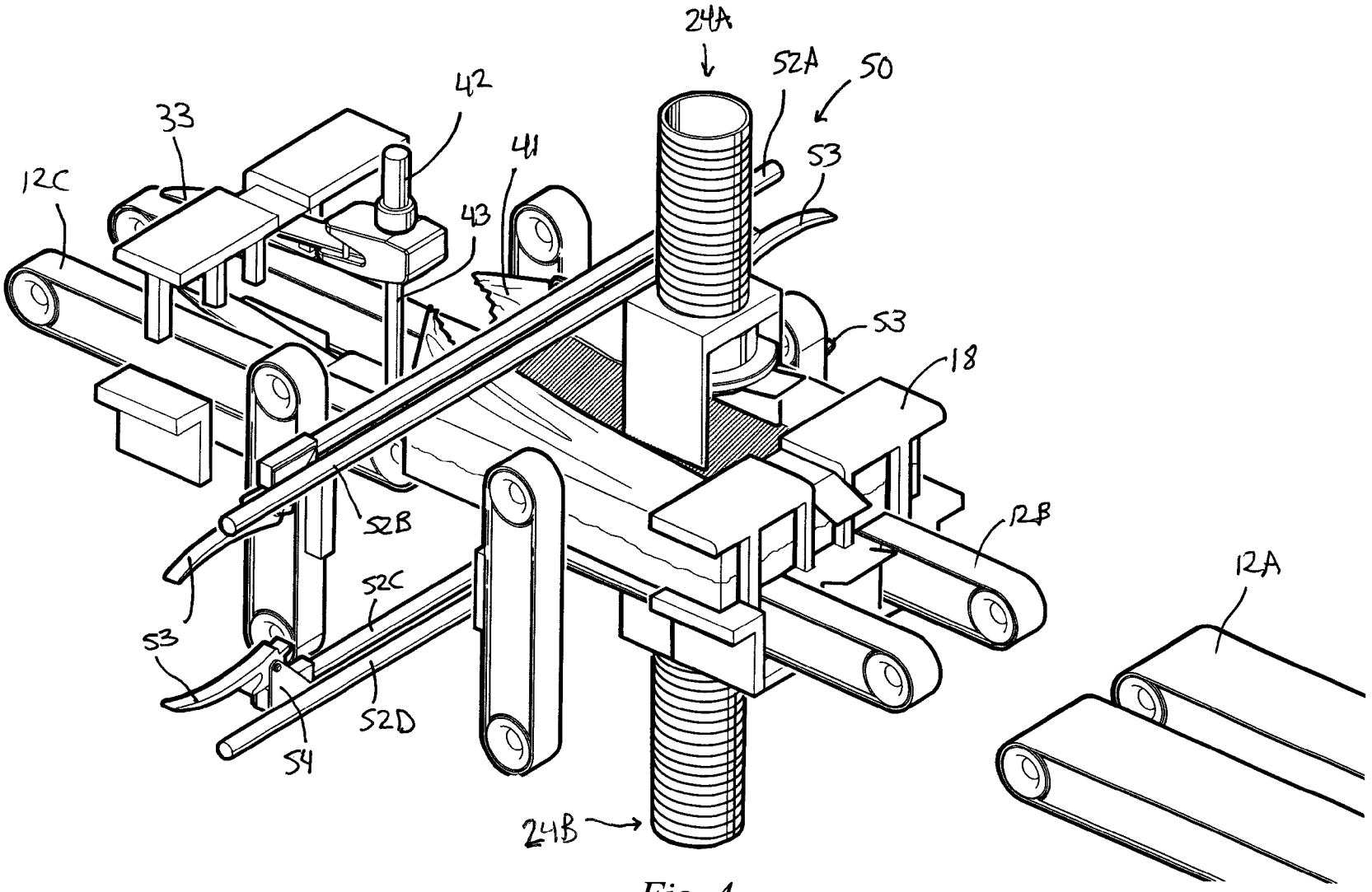
FIG. 4 is a simplified perspective view of the unwrapping machine of FIG. 1 in a fourth position.

As shown in FIG. 4, when the forward travel of pin 43 is completed, it has completely torn through the front end wall of the plastic wrap 41. Bundle 14 has been opened on three sides and is ready for unwrapping. In this example one vertical opener 42 is provided, and this is sufficient for relatively thin bundles. For thicker bundles, a counterpart opener 42 on the underside, in reverse orientation, is preferred.

For peeling the wrap away from the underlying contents, an unwrapping system 50 includes two pairs of parallel rods 52A, 52B above and 52C, 52D below the position where bundle 14 is supported on second conveyors 12B. In the starting position shown in FIG. 4, rods 52 each end in a horizontally extending curved finger 53. Finger 53 of rod 52A is mounted on the end of rod 52A by means of a holder 54 and extends to the left in FIG. 4 from the left side of machine 10. Holders 54 are preferably spring loaded to hold the fingers 53 lightly against the surface of the underlying article. Finger 53 of upper rod 52B is offset horizontally a short distance from rod 52A and extends to the right in FIG. 4 from the right side of machine 10. Finger 53 of lower rod 52C extends in the same direction as finger 53 of rod 52A, and finger 53 of lower rod 52D extends in the same direction as finger 53 of rod 52B.

Figure 5:
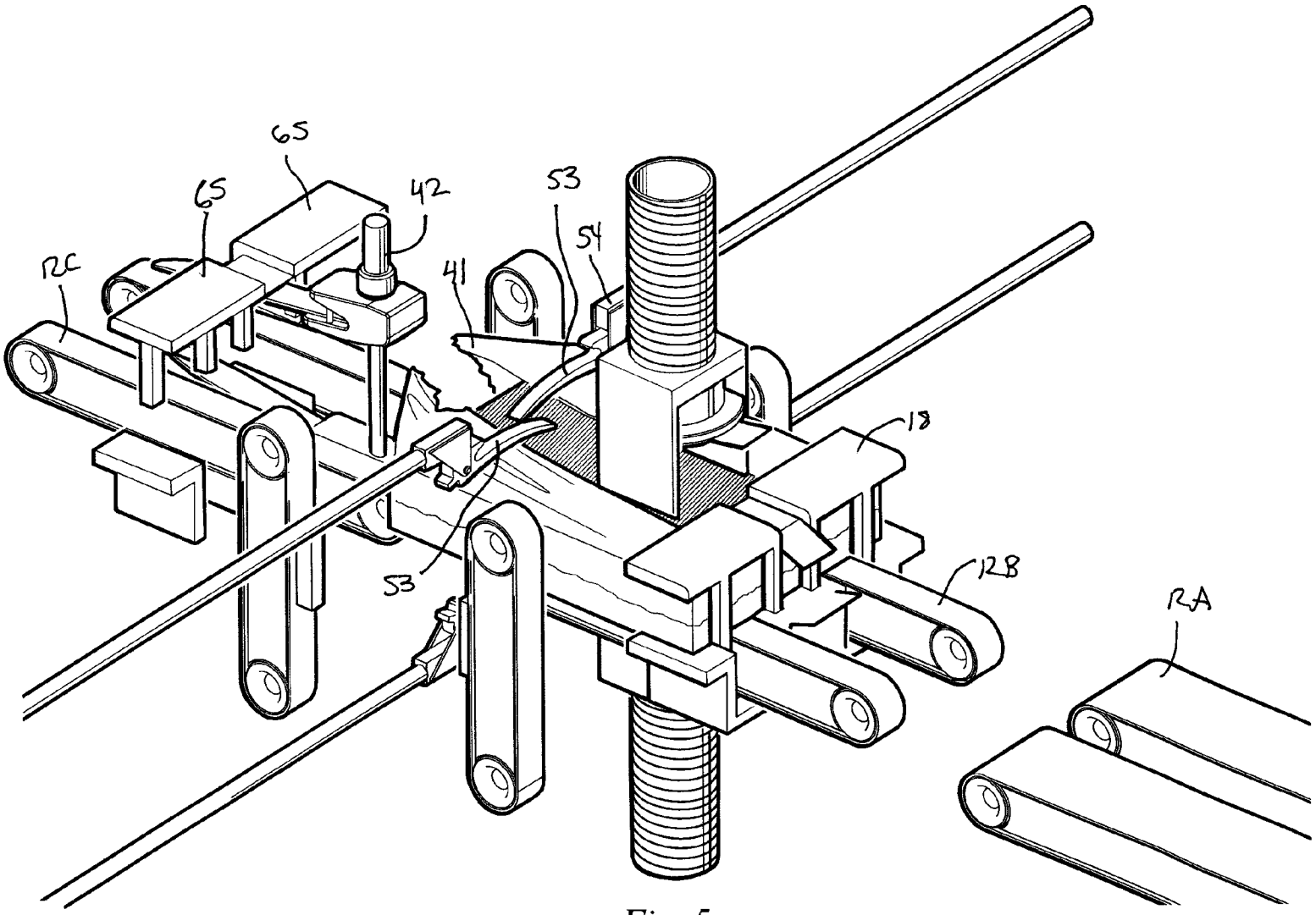
FIG. 5 is a simplified perspective view of the unwrapping machine of FIG. 1 in a fifth position.
Figure 6:
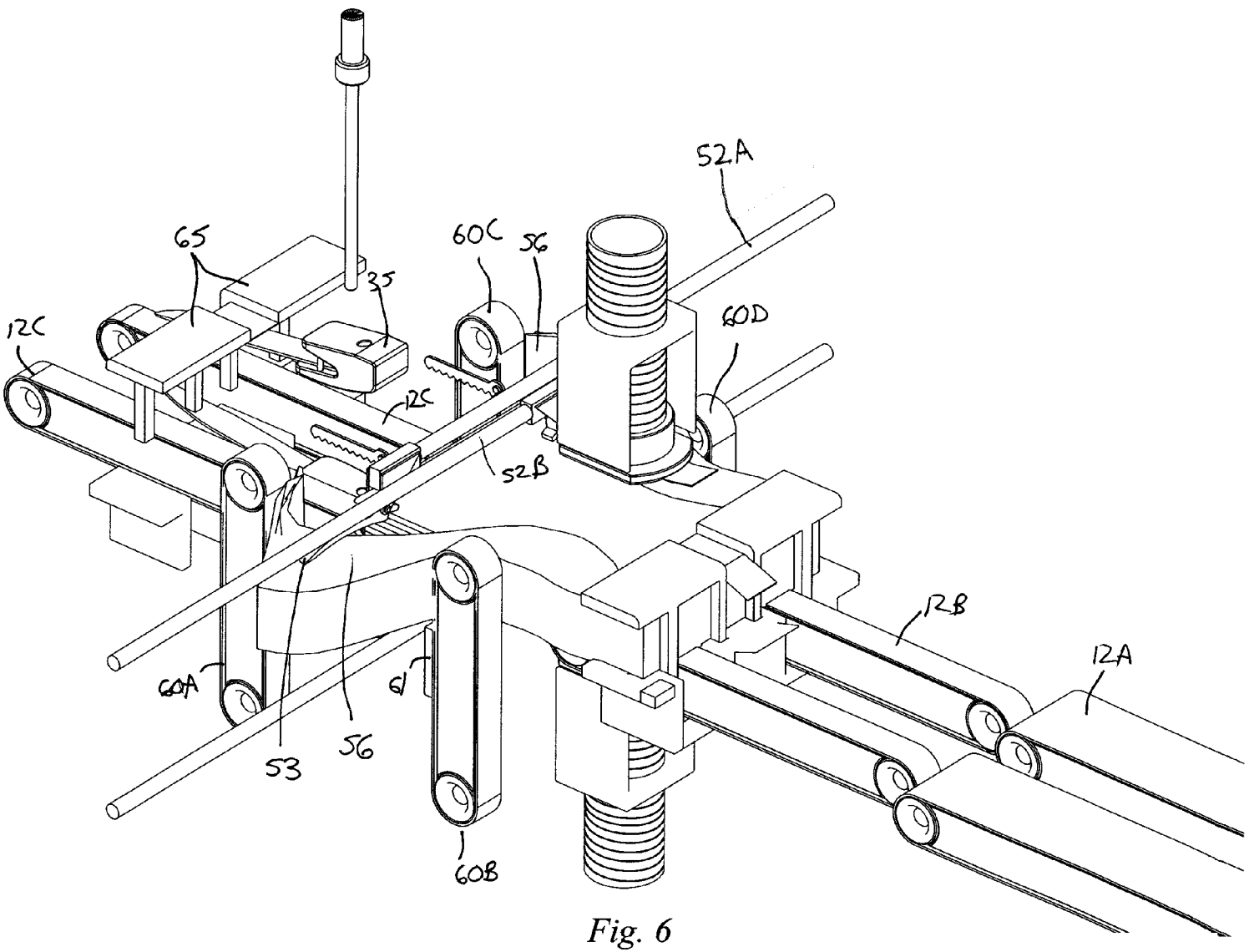
FIG. 6 is a simplified perspective view of the unwrapping machine of FIG. 1 in a sixth position.

Linear actuators for moving rods 52 are at the ends opposite to the fingers 53. During the unwrapping cycle rods 52 move to the positions shown in FIG. 5 so that a pair of fingers 53 are positioned side by side facing in opposite directions above bundle 14 as shown, and below bundle 14 in the same manner. The curved ends of fingers 53 preferably present a convex outer surface that aids fingers 53 in sliding under the open edges 55 of the wrap 41. Rods 52 are then actuated so that they assume the position shown in FIG. 6. Fingers 53 pull edges 55 in opposite directions on both the top and bottom of bundle 14. By this means forward side portions 56 of wrap 41 are pulled outwardly both right and left in FIG. 6.

Figure 7:
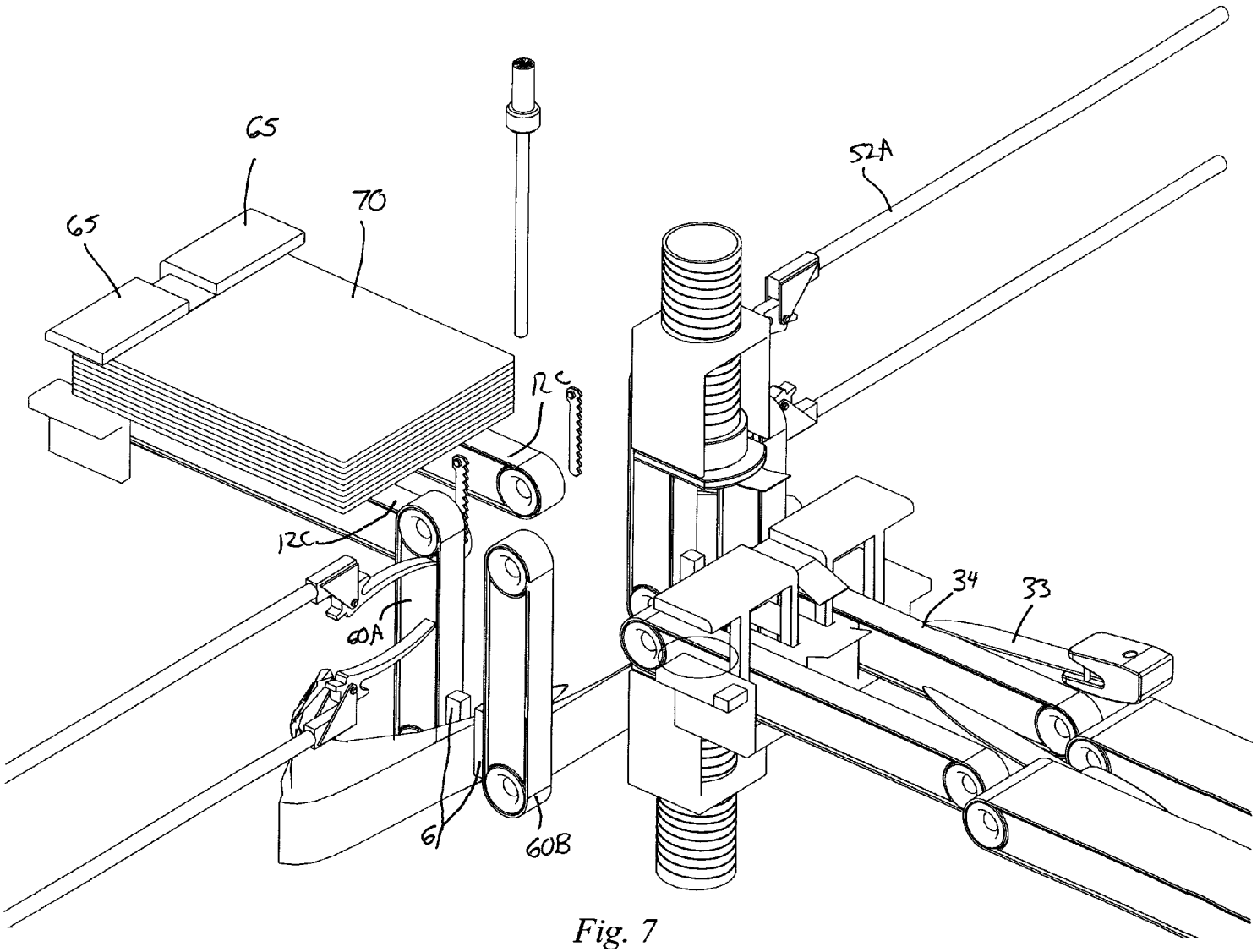
FIG. 7 is a simplified perspective view of the unwrapping machine of FIG. 1 in a seventh position.
Figure 8:
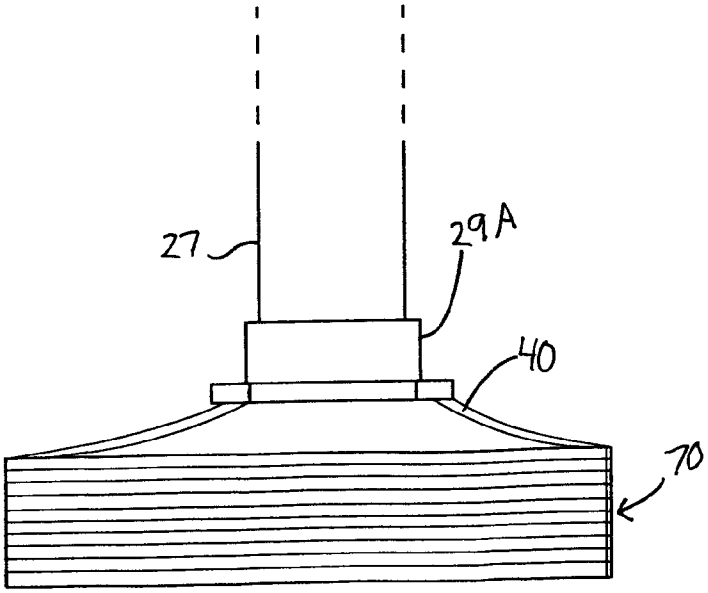
FIG. 8 is a side view of engagement between the suction head and the plastic film during piercing of the film according to the invention.

The front end of bundle 14 is now free of wrap, and bundle 14 is moved further forward for the final stage of wrap removal shown in FIG. 7. To aid in this process pairs of driven vertical belts 60, such as timing belts are provided on the left and right sides of machine 10. Each belt has a gripping pad 61 on its outer surface. Belts 60 are arranged in opposing pairs with gripping pads 61 in opposing positions. The left side front belt 60A faces left side rear belt 60B, and the same is true of belts 60C and 60D on the right. Belts 60 are spaced from each other initially but must move together at the appropriate time so that pads 61 of each pair 60A,B and 60C,D come close to one another as shown in FIG. 7. One or both belts 60 of a pair can move for this purpose.

Figure 7A:
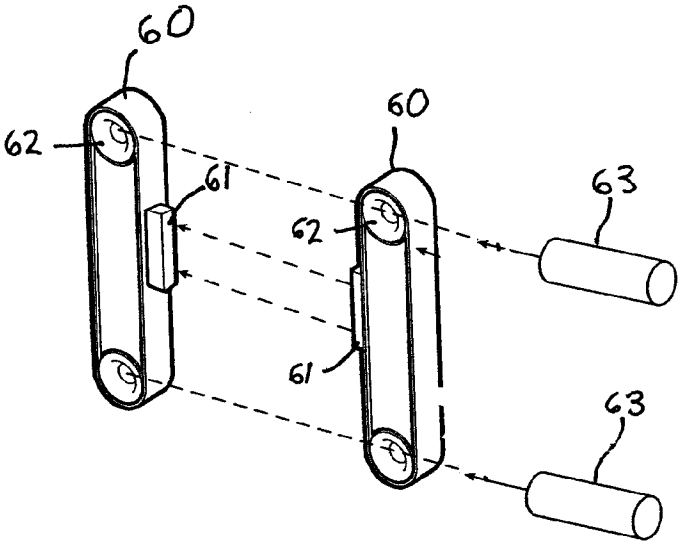
FIG. 7A is a schematic diagram of an actuation system for moving the wrapper takeaway belts of the unwrapping machine of FIG. 1.

As shown in FIG. 7A, belts 60 of each pair can be driven by any suitable means such as power rollers 62. At least one belt is provided with one or more linear actuators 63 for moving the belt assembly horizontally so that its pad 61 comes close to the pad 61 of the belt 60 facing it. By this means wrap 41 is gripped on both sides by two pairs of pads 61.

With wrap 41 held in this manner, a pair of underlying forward belt conveyors 12C similar to conveyors 12B move the contents 70 of bundle 14 forward into contact with a stop or stops 65 at the front end of machine 10. Wrap 41 held on both sides by pairs of pads 61 is removed from contents 70 as contents 70 moves forward. Once stop 65 is contacted, it is possible then to drive each of belts 60 in tandem with each other so that pads 61 move out of contact by passing around the next belt pulley, allowing wrap 41 to drop free into a collection container beneath machine 10. Contents 70 can then be removed manually or continue to be conveyed on an extension of conveyor 12C upon removal of stop 65. All moving parts are then reset for the next unwrapping cycle back tot the positions shown in FIG. 1 as another bundle 14 is presented for unwrapping. Actuators 36, 37 are used to return blades 33A, 33B to their starting positions when the tearing stroke is completed.

The described system thus provides for fully automated unwrapping of a plastic wrapped bundle of flat items such as magazines, catalogs or the like. Unlike known systems for opening boxes or cartons, the system of the invention does not use knives or cutting blades to open packaging. The blades of the present invention are configured to pierce the plastic film with a thrusting motion, not cut it along a line with a sharp edge or the like. The latter approach is not suitable for automated opening of plastic wrapped bundles of flat mail which could be easily damaged by a metal knife or razor blade.

It will be understood that the invention can be employed in other configurations and environments. For example, for better control of bundles 14, both upper and lower drive belts can be provided which clamp the bundle. a) The throat of the upper/lower drive belts can be configured to spread to a distance adequate to accept various wrapped bundle heights. Position and dimension sensors may be deployed as needed so that a computerized control system can adjust the positions of moving parts to accommodate bundles of different sizes. And detectors such as photocells can be used to indicate when the bundle has reached a position at which a further operation should begin. The vacuum system may be provided with a valve for turning suction off and on when required and vacuum powered suction cups may be used to assist in the removal of the plastic wrap, such as to hold it when the bundle contents are removed. It is also possible, although difficult, to omit actuators for moving the blades along the outside of the bundle and instead hold the blades stationary while moving the bundle to producing the relative motion for piercing the wrapping. These and other modifications are within the scope of the appended claims.

The invention claimed is:

1. A machine for removing wrapping from a bundle of flat articles, the machine comprising:

a conveyor configured to transport the bundle through the machine, wherein the bundle is wrapped in the wrapping and wherein the wrapping is a plastic material;

a first blade assembly including a blade having a point and a mechanical actuator having a holder, the blade mounted on the holder, wherein the mechanical actuator is configured to first slide the point along an outer surface of the wrapping for a period of time until the point of the blade pierces the wrapping causing the blade to move beneath the wrapping, and then slide the point along an outer surface of a flat article in the bundle wherein the blade is configured to stretch and tear the wrapping as the blade continues to move beneath the wrapping; and an automated removal and disposal system configured to separate torn wrapping from the flat articles.

2. The machine of claim 1, wherein the automated removal and disposal system includes oppositely directed fingers which insert under an open edge of the wrapping and move apart in a manner that widens the open edge in the wrapping.

3. The machine of claim 1, wherein the automated removal and disposal system is further configured to hold the wrapping and move contents of the bundle away from the wrapping as the bundle is held.

4. The machine of claim 1, wherein the blade is substantially flat with rounded, dull edges and is positioned such that the blade slides along the outer surface of the flat article with a flat side of the blade against the flat article.

5. The machine of claim 4, wherein the blade is made of a resilient plastic.

6. The machine of claim 1, wherein the first blade assembly is disposed in a position to move along a top surface of the bundle, the machine further comprising:

a second blade assembly disposed to move along a bottom surface of the bundle at a same time as the first blade assembly moves along the top surface, the second blade assembly piercing the wrapping on a side of the bundle that is opposite from where the first blade assembly pieces the wrapping.

7. The machine of claim 1, further comprising:

a vacuum system including a vacuum head configured to apply suction to an area of the wrapping covering the bundle, drawing the wrapping towards the vacuum head and creating a bulge in the wrapping, wherein the mechanical actuator is configured to move the blade to pierce the bulge created in the wrapping.

8. The machine of claim 7, wherein the blade is made of plastic tapering to a sharp point but which has dull side edges.

9. The machine of claim 7, wherein the vacuum system is further configured to draw heated air to the area in the wrapping where the bulge is to be created to soften the wrapping.

10. The machine of claim 1, wherein the mechanical actuator is configured to slide the point of the blade along the surface of the outer surface of the wrapping, such that the point of the blade pierces the wrapping causing the blade to move between the wrapping and the outer surface of the flat article while sliding along the outer surface the flat article.

11. The machine of claim 1, wherein the blade has the point and a substantially-flat surface and wherein the mechanical actuator is configured to first slide the point and the substantially-flat surface of the blade along the outer surface of the wrapping for the period of time until the point of the blade pierces the wrapping causing the blade to move beneath the wrapping and then slide the point and the substantially-flat surface of the blade along the outer surface of the flat article in the bundle.

12. A machine for removing wrapping from a bundle of flat articles, the machine comprising:

a conveyor configured to transport the bundle through the machine, wherein the bundle is wrapped in the wrapping and wherein the wrapping is a plastic material;

a vacuum system including a vacuum head configured to apply suction to an area of the wrapping covering an outer face of the bundle, drawing the wrapping towards the vacuum head and creating a bulge in the wrapping;

a first blade assembly including a blade having a point and a mechanical actuator having a holder, the blade mounted on the holder, wherein the mechanical actuator is configured to slide the point first along an outer surface of the wrapping for a period of time until the point of the blade pierces the bulge in the wrapping causing the blade to move beneath the wrapping, and then along an outer surface a flat article in the bundle, wherein the blade is configured to stretch and tear the wrapping as the blade continues to move beneath the wrapping; and an automated removal and disposal system configured to separate torn wrapping from the flat articles.

13. The machine of claim 12, wherein the vacuum system is further configured to draw heated air to the area in the wrapping where the bulge is to be created to soften the wrapping.

14. The machine of claim 12, wherein the blade has the point and a substantially-flat surface and wherein the mechanical actuator is configured to first slide the point and the substantially-flat surface of the blade along the outer surface of the wrapping for the period of time until the point of the blade pierces the bulge in the wrapping causing the blade to move beneath the wrapping and then slide the point and the substantially-flat surface of the blade along the outer surface of the flat article in the bundle.

* * * * *